US006008567A

United States Patent [19]

Aizawa et al.

[11] Patent Number: 6,008,567

[45] Date of Patent: Dec. 28, 1999

[54] POWER-SAVING DISCHARGE LAMP

[75] Inventors: Masanobu Aizawa; Tomohiko Sakamoto; Masalu Ito, all of Iwaki, Japan

[73] Assignee: Stanley Electric Co., Ltd., Tokyo, Japan

[21] Appl. No.: 09/097,039

[22] Filed: Jun. 12, 1998

[30] Foreign Application Priority Data

Jun. 13, 1997 [JP] Japan ..... 9-156625

[51] Int. Cl.[6] ..... H01J 61/00

[52] U.S. Cl. ..... 313/25; 313/26; 313/493; 313/567; 313/292

[58] Field of Search ..... 313/25, 26, 493, 313/484, 567, 292

[56] References Cited

U.S. PATENT DOCUMENTS 1,738,991 12/1929 Fink et al. ..... 313/26

1,826,384 10/1931 Beck ..... 313/26

1,858,712 5/1932 Louttit ..... 313/26

1,997,781 4/1935 Thomas ..... 313/26

5,220,236 6/1993 Washburn et al. ..... 313/26

*Primary Examiner*—Ashok Patel

*Attorney, Agent, or Firm*—Ostrolenk, Faber, Gerb & Soffen, LLP

[57] ABSTRACT

A power-saving discharge lamp 1 wherein gap control material 6 is provided in a clearance between an internal bulb 2 and an external bulb 5, having a smaller thickness than the dimension of the clearance. Nonuniformity of the clearance between the both bulbs caused by difficulties in supporting the internal bulb 2 while welding the external bulb 5 is eliminated and a suitable clearance is automatically provided by the gap control material 6 to prevent degradation of the heat insulation effect.

1 Claim, 2 Drawing Sheets

POWER-SAVING DISCHARGE LAMP

BACKGROUND OF THE INVENTION

1. Field of the Invention

The present invention relates to a power-saving discharge lamp, and more particularly, to a discharge lamp such as a cold cathode fluorescent lamp wherein a bulb section is double-sheathed by an internal bulb and an external bulb, and a clearance between both bulbs is evacuated, preventing loss of heat energy when lighted, in order to reduce power consumption.

2. Background Art

FIG. 3 illustrates an example of a power-saving discharge lamp 90 of this kind according to prior arts. The manufacturing method of the power-saving discharge lamp 90 is as follows. Firstly, a conventional discharge lamp 93 is formed by sealing the both ends of an internal bulb 91, inside of which is coated with fluorescent material layer 91*a,* by a bead stem 92 to which an electrode 92*a* and a lead wire 92*b* are attached.

Then, the power-saving discharge lamp 90 is formed by inserting the conventional discharge lamp 93 into an external glass bulb 94, and welding the both ends of the external glass bulb 94 with a gas burner G or the like to double-sheathe the bulb section. In the welding process, the degree of vacuum of the clearance between the internal bulb 91 and the external bulb 94 is raised to $1\times10^{-3}$ Torr or higher, which improves the heat insulation property between the bulbs 91 and 94, and prevents loss of heat energy when lighted in order to reduce power consumption.

However, in the case with the power-saving discharge lamp 90 constructed according to prior arts, the conventional discharge lamp 93, which is inserted into the external bulb 94, is difficult to support from outside while the external bulb 94 is being welded. Thus after welding of the external bulb 94 is completed, the clearance between the internal bulb 91 and the external bulb 94 tends to be nonuniform as shown in FIG. 4, which not only causes an inaccurate dimension but also, if the nonuniformity goes to an extreme, raises a problem of losing the power-saving effect.

To prevent the nonuniformity of the clearance described above, a cautious and skilled work is required in the welding process of the external bulb 94, as well as a long processing time. Therefore, together with the inaccurate dimension due to the nonuniformity described above, a problem of decrease in productivity also arises, which are the problems to be solved.

SUMMARY OF THE INVENTION

A first object of the present invention is to provide a power-saving discharge lamp comprising an internal bulb and an external bulb, a clearance with a predefined dimension being provided between said both bulbs and evacuated, wherein gap control material having a smaller thickness than said predefined dimension is provided in the clearance between said internal bulb and external bulb.

A second object of the present invention is to provide a power-saving discharge lamp as above wherein, said gap control material is provided in a nonluminescent section in said clearance of the power-saving discharge lamp, and provided by coating in a state in which said gap control material is mixed with getter material.

BRIEF DESCRIPTION OF THE DRAWINGS

These and other objects and advantages of the present invention will become clear from the following description with reference to the accompanying drawing, wherein.

DETAILED DESCRIPTION OF THE PREFERRED EMBODIMENTS

Figure 1:
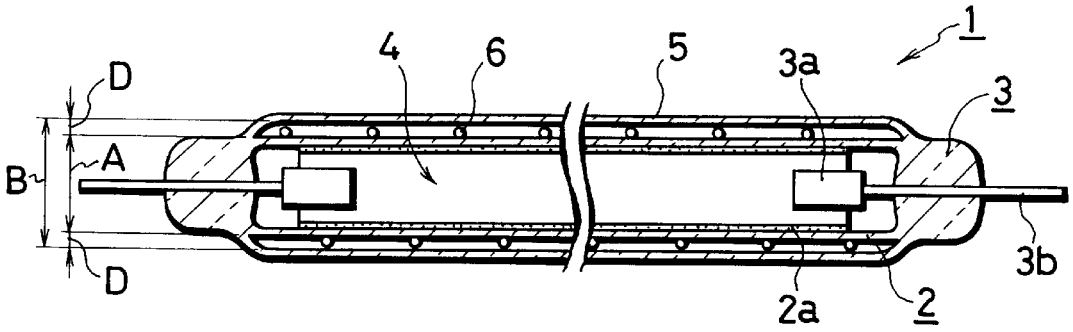
FIG. 1 is a cross sectional view showing an embodiment of a power-saving discharge lamp according to the present invention.

The present invention is described in detail hereinafter with reference to embodiments shown in the accompanying drawings. In FIG. 1, reference numeral 1 designates a power-saving discharge lamp according to the present invention. The power-saving discharge lamp 1 is similar to examples according to prior arts in that the bulb section is double-sheathed by an internal bulb 2 and an external bulb 5.

When forming the power-saving discharge lamp 1, a conventional discharge lamp 4 is formed beforehand by sealing the both ends of the internal bulb 2, inside of which is coated with fluorescent material layer 2*a,* by a bead stem 3 to which an electrode 3*a* and a lead wire 3*b* are attached. Then the external bulb 5 is welded to the bead stem 3 to form the power-saving discharge lamp 1. The process is similar to prior arts in that the clearance between the internal bulb 2 and the external bulb 5 is evacuated.

In the above construction of the present invention, gap control material 6 is provided between said internal bulb 2 and external bulb 5. As the gap control material 6, a material, such as a glass ball, with a small characteristic or dimensional variation with respect to temperature change and a low thermal conductivity is adopted.

Here, the designed dimension D of the clearance between the internal bulb 2 and the external bulb 5 is given by (B-A)/2, where A is the designed dimension of the outside diameter of the internal bulb 2, and B is the designed dimension of the inside diameter of the external bulb 5. On the other hand, a tolerance is given for dimensions of both the outside diameter of the internal bulb 2 and the inside diameter of the external bulb 5 when the power-saving discharge lamp 1 is actually manufactured. Therefore, in the present invention, the thickness of the layer of the coated gap control material 6 is supposed to have a thickness which includes the above mentioned tolerance and is smaller than the above mentioned designed clearance 9.

Now, a suitable method can be adopted for providing said gap control material 6 in the clearance between the internal bulb 2 and the external bulb 5. For example, a method in which the gap control material 6, a suitable amount of which is mixed into a volatile solvent such as alcohol, is spray-coated on the outer surface of the conventional discharge lamp 4, before inserting the conventional discharge lamp 4 into the external bulb 5.

If the external bulb 5 is welded to the bead stem 3 by means similar to those in prior arts after the conventional discharge lamp 4 is inserted into the external bulb 5, the clearance between the internal bulb 2 and the external bulb 5 will never become narrower than the outside diameter of said gap control material 6. In addition, the solvent used when providing the gap control material 6 is removed by heating for welding and evacuating the clearance.

Next, the operation and the effect of the power-saving discharge lamp 1 of the above construction according to the present invention will be described. By providing gap control material 6 having a suitable diameter between the internal bulb 2 and the external bulb 5, according to the present invention, the internal bulb 2 and the external bulb 5 will never come closer than the dimension provided with the outside diameter of the gap control material 6, ensuring sufficient clearance between the both bulbs 2 and 5. This certifies that the power-saving effect will be exerted.

Moreover, in the process of welding the external bulb 5 to the conventional discharge lamp 4, the clearance between the both bulbs 2 and 5 automatically falls within a predefined range due to provision of said gap control material 6. Therefore, particular treatments or cautious works for maintaining the clearance becomes entirely unnecessary, which brings about effect of reduced deficiencies as well as improved productivity.

Here, strictly speaking, provision of said gap control material 6, causing connection of the internal bulb 2 and the external bulb 5 by the gap control material 6, may lead to heat loss by heat transfer from the internal bulb 2 to the external bulb 5 via the gap control material 6. Actually, however, the amount of gap control material needed to maintain the clearance is relatively small, and the contact area of the internal bulb 2 and the external bulb 5 is also small because the both bulbs point-contact to each other, thus the occurred heat loss is within a negligible range.

Figure 2:
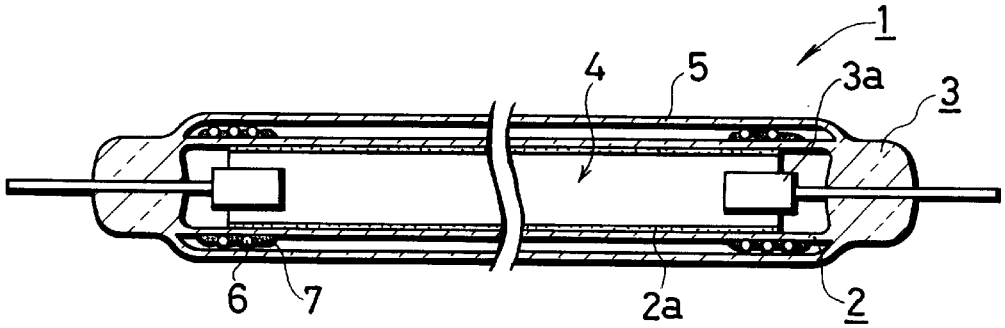
FIG. 2 is a cross sectional view showing another embodiment of a power-saving discharge lamp according to the present invention.
Figure 3:
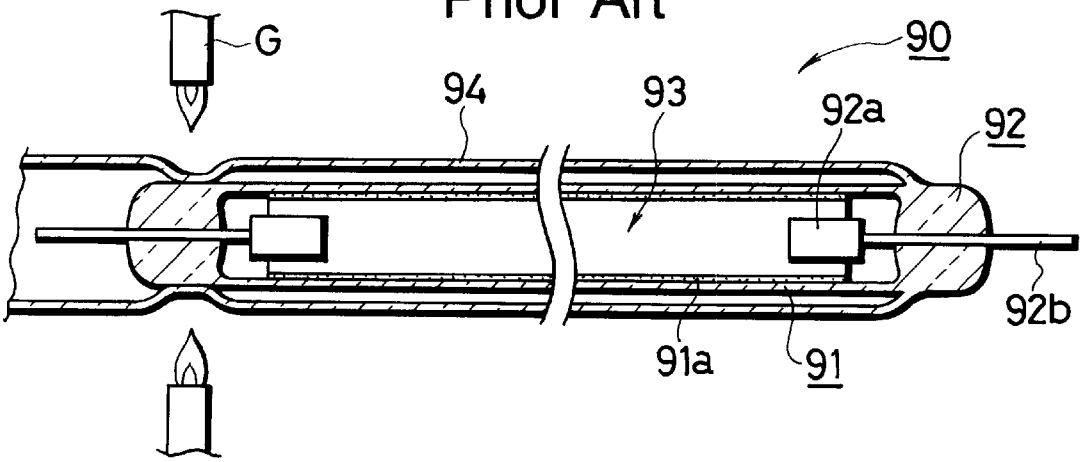
Fig. 3 Prior Art
FIG. 3 is an illustration describing a welding process of an external bulb according to prior arts; and, FIG. 4 is a cross sectional view showing deficiencies according to prior arts.
Figure 4:
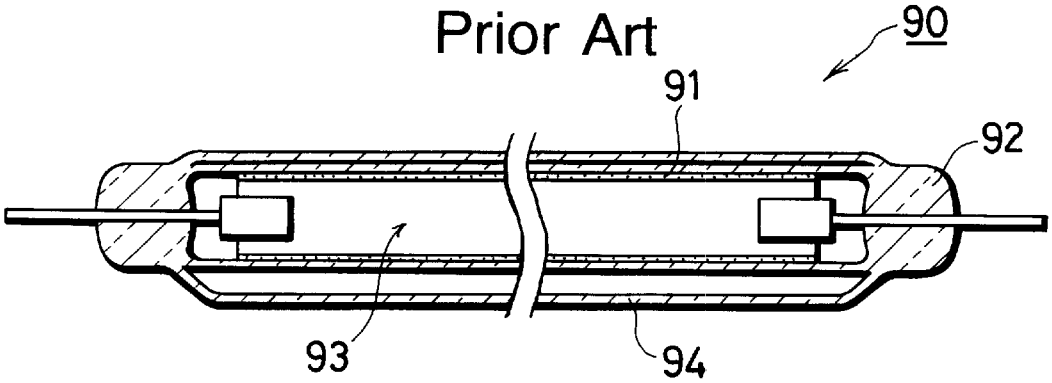
Fig. 4 Prior Art

FIG. 2 shows another embodiment of the present invention. While, in the above described embodiment, the gap control material 6 is coated all over the periphery of the conventional discharge lamp 4, i.e. the internal bulb 2, in a uniformly distributed manner, it is also possible to maintain the clearance without coating the gap control material 6 all over the surface.

According to this embodiment, there is no harm with the solvent or the binder, used in coating of the gap control material 6, being opaque if provision of the gap control material 6 is limited to both ends of said internal bulb 2, i.e. a location closer to the end than the electrode 3*a,* which is the nonluminescent section of the conventional discharge lamp 4. For example, the above mentioned gap control material 6 is mixed beforehand with getter material 7 such as barium (Ba), zirconium (Zr), and coated.

By the method described above, coating processes of the gap control material and the getter material 7 can be performed simultaneously. According to the above embodiment, serious degradation of heat insulation effect can be prevented because the getter material 7 used as coating binder of the gap control material 6 absorbs the gases which, as time elapses, may be released from the both bulbs 2 and 5, and lower the degree of vacuum between the both bulbs 2 and 5.

According to the present invention described above, non-uniformity of the clearance between the both bulbs caused by difficulties in supporting the internal bulb while welding the external bulb, which is inherent in prior arts, is eliminated to prevent degradation of the heat insulation effect. Furthermore, prevention of inaccurate dimension also becomes possible, which exerts an outstanding effect in improving quality and performance of power-saving discharge lamps of this kind At the same time, because of the gap control material, the clearance between the internal bulb and the external bulb can be automatically defined by only inserting the internal bulb into the external bulb. Therefore, jigs, manhours, or the like for maintaining the clearance between the both bulbs become entirely unnecessary in the welding process of the external bulb, and generation of defectives during the welding process can be prevented, which exerts an outstanding effect in improving productivity as well.

Furthermore, the problem of losing the heat insulation effect due to released gases, which may lower the degree of vacuum between the both bulbs, can be prevented at the same time and an outstanding effect in improving performance can be exerted, because the gap control material is provided in a nonluminescent section in the clearance of the power-saving discharge lamp, and provided by coating in a state in which said gap control material is mixed with getter material.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A power-saving discharge lamp comprising:

an external bulb;

an internal bulb provided within said external bulb, said internal bulb having two ends, an inside of said internal bulb being coated with fluorescent material and being filled with a gas, a clearance provided between said external and internal bulbs, said clearance having a predefined dimension and being evacuated;

a pair of electrodes provided in said inside of said internal bulb;

lead wires coupled to said electrodes and extending out of each of said ends of said internal bulb; and a gap control material provided in a nonluminescent section of the clearance between said internal bulb and external bulb, said gap control material having a smaller thickness than said predefined dimension, said gap control material being provided by coating in a state in which said gap control material is mixed with getter material.

* * * * *